US005278018A

United States Patent [19]

Young et al.

[11] Patent Number: 5,278,018

[45] Date of Patent: Jan. 11, 1994

[54] MAGNETIC TONER COMPOSITIONS CONTAINING CHARGE ENHANCING ADDITIVE PARTICLES

[75] Inventors: Eugene F. Young, Rochester; Jonathan G. Hyland, Walworth, both of N.Y.

[73] Assignee: Xerox Corporation, Stamford, Conn.

[21] Appl. No.: 703,943

[22] Filed: May 22, 1991

[51] Int. Cl.[5] ..... G03G 9/00

[52] U.S. Cl. ..... 430/110; 430/106.6

[58] Field of Search ..... 430/110, 106.6

[56] References Cited

U.S. PATENT DOCUMENTS

| | | | |
|---|---|---|---|
| 3,590,000 | 6/1971 | Palermiti et al. | 252/62.1 |
| 4,298,672 | 11/1981 | Lu | 430/108 |
| 4,333,040 | 6/1982 | Okamoto et al. | 315/169.2 |
| 4,530,894 | 7/1985 | Imamura et al. | 430/106.6 |
| 4,600,676 | 7/1986 | Terada et al. | 430/106.6 |
| 4,702,988 | 10/1987 | Fukumoto et al. | 430/137 |
| 4,758,493 | 7/1988 | Young et al. | 430/106.6 |
| 4,824,750 | 4/1989 | Mahalek et al. | 430/99 |
| 4,828,954 | 5/1989 | Hashimoto et al. | 430/110 |
| 5,145,762 | 9/1992 | Grushkin | 430/106.6 |

FOREIGN PATENT DOCUMENTS

| | | |
|---|---|---|
| 1442835 | 7/1976 | United Kingdom . |

*Primary Examiner*—Marion E. McCamish
*Assistant Examiner*—Mark A. Chapman
*Attorney, Agent, or Firm*—E. O. Palazzo;

[57] ABSTRACT

A negatively charged toner composition comprised of crosslinked resin particles, silane treated magnetite particles, wax particles, charge enhancing additive particles, and surface additive particles.

25 Claims, No Drawings

MAGNETIC TONER COMPOSITIONS CONTAINING CHARGE ENHANCING ADDITIVE PARTICLES

BACKGROUND OF THE INVENTION

This invention is generally directed to toner and developer compositions, and more specifically the present invention is directed to toner compositions, including magnetic, single component, and colored toner compositions. In one embodiment of the present invention, the toner compositions are comprised of resin particles, certain magnetite particles, a charge enhancing additive, a wax component, and external additives, such as colloidal silicas like Aerosil R972 ® or Aerosil R812 ®, available from Degussa Chemical. Furthermore, in another embodiment of the present invention there are provided single component toner compositions comprised of resin particles, certain magnetic components such as silane treated magnetites like Toda MAT305K3, a (3-chloropropyl)trimethoxysilane treated magnetite, obtained from Toda Kogyo Corporation of Japan, alkylene waxes like polypropylene, and polyethylene with a low molecular weight, for example from about 500 to about 20,000, and preferably with an average molecular weight of about 4,000, and available from Sanyo Corporation of Japan, charge control additives, and as external surface additives metal salts of fatty acids, colloidal silicas, or mixtures thereof. The toner compositions of the present invention are useful in electrostatographic imaging systems, especially xerographic imaging and printing systems wherein the toner is substantially insensitive to relative humidity, and enables developed images with excellent optical density.

Developer and toner compositions with certain waxes therein are known. For example, there are illustrated in U.K. Patent Publication 1,442,835, the disclosure of which is totally incorporated herein by reference, toner compositions containing resin particles, and polyalkylene compounds, such as polyethylene and polypropylene of a molecular weight of from about 1,500 to 6,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. In addition, many patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference Palmeriti et al. U.S. Pat. No. 3,635,704, the disclosure of which is totally incorporated herein by reference. Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxypolyethylene glycols; terephthalic acids; and the like, reference column 7, lines 13 to 43.

Described in U.S. Pat. No. 4,367,275 are methods of preventing offsetting of electrostatic images of the toner composition to the fuser roll, which toner subsequently offsets to supporting substrates such as papers wherein there are selected toner compositions containing specific external lubricants including various waxes, see column 5, lines 32 to 45.

Of background interest are U.S. Pat. Nos. 3,165,420; 3,236,776; 4,145,300; 4,271,249; 4,556,624; 4,557,991 and 4,604,338.

Moreover, toner and developer compositions containing charge enhancing additives, especially additives which impart a positive charge to the toner resin, are well known. Thus, for example, there is described in U.S. Pat. No. 3,893,935 the use of certain quaternary ammonium salts as charge control agents for electrostatic toner compositions. There are also described in U.S. Pat. No. 2,986,521 reversal developer compositions comprised of toner resin particles coated with finely divided colloidal silica. According to the disclosure of this patent, the development of images on negatively charged surfaces is accomplished by applying a developer composition having a positively charged triboelectric relationship with respect to the colloidal silica. Further, there is illustrated in U.S. Pat. No. 4,338,390, the disclosure of which is totally incorporated herein by reference, developer and toner compositions having incorporated therein as charge enhancing additives organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride. Toner compositions with certain negative charge enhancing additives are also known. Further toners with magnetites, such as Mapico Black, are known. The aforementioned Mapico Black toners have a number of disadvantages with certain resin particles, for example they are sensitive to relative humidity, and this and other disadvantages are avoided, or substantially prevented with the toners and processes of the present invention. Other prior art disclosing positively charged toner compositions with charge enhancing additives include U.S. Pat. Nos. 3,944,493; 4,007,293; 4,079,014 and 4,394,430.

Toner compositions with negative charge enhancing additives, such as TRH, available as Spilon Black, reference for example U.S. Pat. No. 4,333,040, the disclosure of which is totally incorporated herein by reference, are also known. Moreover, toner compositions with a vinyl monomer obtained by polymerizing said monomer in the presence of a titanate coupling agent, and at least one inorganic material, such as magentite, is disclosed in U.S. Pat. No. 4,600,676. With the invention of the present application wherein there is selected a magnetite treated with a silane coupling, a number of advantages are achievable as compared to toners with the aforementioned titanate treated magnetite, such as a higher optical density at various relative humidities, such as above 60 percent.

Although the above described toner and developer compositions are useful for their intended purposes, there is a need for improved compositions. More specifically, there is a need for toner compositions, including single component compositions which possess advantages not achievable with similar prior art toner compositions. There is also a need for toner compositions with reduced humidity sensitivity, no, or minimal offsetting of toner, and wherein developed images with optical densities of 1.2 to 1.5 result. Also, there is a need for single component toners wherein the developed images thereof are of excellent resolution, and no significant background or variation of optical density on the paper substrate results.

SUMMARY OF THE INVENTION

It is a feature of the present invention in embodiments thereof to provide toner compositions which possess many of the above noted advantages.

Another feature of the present invention resides in the provision of toner compositions with excellent humidity characteristics, and, for example, stable optical densities at relative humidities of from about 50 to about 80 percent as measured by known means, such as the optical densitometer test.

Another feature of the present invention resides in the provision of toner compositions that can enable developed images with excellent optical densities of, for example, 1.2 or more, and more specifically from about 1.2 to about 1.5, in embodiments.

In another feature of the present invention there are provided processes for the preparation of toner compositions.

Additionally, in yet another feature of the present invention there are provided toner and developer compositions with certain waxes therein or thereon that enable images of excellent quality inclusive of acceptable resolutions.

In another feature of the present invention there are provided negatively charged toner compositions with certain waxes therein or thereon, which toners are useful for causing the development of electrostatic latent images, including in some instances color images.

These and other features of the present invention can be accomplished in embodiments by providing toner compositions comprised of resin particles, magnetite particles, waxes and charge enhancing additives, and which toners contain surface additives. More specifically, the present invention is directed to toner compositions comprised of resin particles, especially styrene methacrylates, like styrene butyl methacrylate crosslinked with, for example, known components, such as divinylbenzene, certain treated magnetites, waxes, and charge enhancing additives. In one embodiment of the present invention there are provided negatively charged toner compositions comprised of crosslinked styrene butyl methacrylate resin particles, silane treated magnetic particles, especially Toda MAT305K3, wax components, negative charge enhancing additives, and toner surface additives.

In one embodiment the toners of the present invention are comprised of from about 50 to about 70 percent by weight of a crosslinked, with divinylbenzene for example, styrene n-butyl methacrylate resin, and preferably from about 58 to about 62 percent, from about 20 to about 35 percent by weight of a silane treated magnetite and preferably from about 28 to about 2 percent, from about 5 to about 9 weight percent of polypropylene wax, and from about 0.1 to about 5 percent of a negative charge enhancing additive, such as aluminum complex metal salts as mentioned herein, like [3-hydroxy-4-(2-hydroxy-3,5-dinitrophenylazo-N-phenyl-2-naphthalenecarboxamidato-2-hydrogen-chromate].

Colloidal silica surface additives can be added in various effective amounts, such as from about 0.1 to about 1.2 percent by weight.

Examples of known toner resins that may be selected for the present invention and can be present in various effective amounts such as, for example, from about 50 percent by weight to about 75 percent by weight, include polyesters, polyamides, epoxy resins, polyurethanes, polyolefins, vinyl resins, styrene acrylates, styrene methacrylates, styrene butadienes, and polymeric esterification products of a dicarboxylic acid and a diol comprising a diphenol. Various suitable vinyl resins may be selected as the toner resin including homopolymers or copolymers of two or more vinyl monomers. Typical vinyl monomeric units include styrene, p-chlorostyrene, vinyl naphthalene, unsaturated monoolefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylamide; vinyl ethers such as vinyl methyl ether, vinyl isobutyl ether, and vinyl ethyl ether; N-vinyl indole; N-vinyl pyrrolidone; and the like. Specific known toner resins include styrene butadiene copolymers, especially styrene butadiene copolymers prepared by a suspension polymerization process reference, U.S. Pat. No. 4,558,108, the disclosure of which is totally incorporated herein by reference; PLIOLITES® and PLIOTONES® obtained from Goodyear Chemical Company; and mixtures thereof. The aforementioned resins are crosslinked by known means, such as by the reaction thereof with divinylbenzene, or the crosslinked resins can be obtained from a number of sources, such as Sanyo Chemical Company.

As one crosslinked toner resin there can be selected the esterification products of a dicarboxylic acid and a diol comprising a diphenol, which components are illustrated in U.S. Pat. No. 3,590,000, the disclosure of which is totally incorporated herein by reference. Other specific toner resins include styrene/methacrylate copolymers, styrene/acrylate copolymers, and styrene/-butadiene copolymers, especially those as illustrated in the aforementioned patent; and styrene butadiene resins with high styrene content, that is exceeding from about 80 to 85 percent by weight of styrene, which resins are available as PLIOLITES® from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol and pentaerythritol.

Examples of charge additives present in various effective amounts, such as for example from about 0.5 to about 10, and preferably from about 1 to about 3 weight percent include organic metal complexes of monoazo dyes such as TRH [3-hydroxy-4-92-hydroxy-3,5-dinitrophenylazo-N-phenyl-2-naphthalenecarboxamidato-2-hydrogen-chromate], and chelated compounds as referenced in Japanese Patent Publications 201153/1966, 27596/1968, 5397/1969, 26478/1970, and U.S. Pat. No. 4,333,040, the disclosures of which are totally incorporated herein by reference. Other examples of charge control additives are acetylacetone complexes or salicylic acid type metal salts or complexes.

Silane treated magnetites, all available, such as EPT1000 TM available from Toda Kogyo, MB22 TM available from Titan Kogyo and MO8029 available from Harcross TM, and present in various effective amounts, such as for example from about 20 to about 40, and preferably from about 20 to about 35 weight percent can be selected for the toners of the present invention. Magnetites treated with (3-chloropropyl)trimethoxysilane, hexamethyldisilazane, trimethylsilane, tristearyltitanate, trimethylethoxysilane, hexamethyldisiloxane and dimethylpolysiloxane having from 2 to about 12 siloxane units per molecule and each containing one hydroxyl group bonded to Si at the terminal ends, and the like are specific examples of components selected to enhance the hydrophobicity thereof. Magnetites are known, and include, for example, MAPICO BLACK TM, Northern pigment magnetites, and the like.

Waxes that function primarily as a cleaning lubricant, and to prevent, or minimize offset of toner to a paper substrate, that may be selected and that are present in various effective amounts, such as for example from about 1 to about 12 weight percent, include polypropylene and polyethylene, reference British patent 1,442,835, especially Viscol 550P TM available from Sanyo Chemical Company of Japan. Other waxes available for selection include Viscol 660P TM, Hamrock P40 TM, and Wego GT8520 with, for example, an average molecular weight of from about 3,000 to about 4,000.

Surface additives are known and include colloidal silicas like Aerosil R972 TM, Aerosil R976 TM, and the like; metal salts of fatty acids, such as zinc stearate, and the like, which additives are usually present in amounts of from about 0.1 to about 3 weight percent. The primary function of these surface additives is to enhance flowability, cleaning and lubrication of surfaces. Preferably only the silicas are selected as surface additives.

The toner compositions of the present invention can be prepared by known melt mixing, or extrusion processes followed by attrition and classification to provide toners with an average particle diameter of from about 8 to about 20 microns. In one embodiment, the toners of the present invention are prepared as follows, thereby enabling compositions that will permit images with excellent optical densities; Banbury melt mixing of the components of resin, wax, charge additive, and treated magnetite to allow fusing of the material components at 230° F., followed by roll milling. The resulting product was cooled and crushed by a cutter mill, pulverized by jet milling, and classified by an air classifier to obtain a classified powder toner with an average particle volume diameter of from about 10 to about 20 microns. By increasing the rubber mill time to from about 5 to about 10 minutes, and by changing the blend conditions of the external additive from about 1.5 minutes at high speed (1,507 RPM of the blades) on a 150 liter production Henschel blender to 75 percent (1,129 RPM of the blades) for 0.75 minute the initial low density toner problem was eliminated, or minimized. Important known toner process parameters in embodiments that can be monitored include Banbury cycle time and rubber mill cycle time by means of timers, rubber mill gap by measuring lead pellets with a micrometer, and fusing temperature by thermosensors. In the jet mill operation the material component amounts and ratios are, for example, checked by X-ray while particle size distributions, and especially volume median are monitored by means of an electrical sensing zone using Ohm's Law, that is a Coulter Counter.

The toners of the present invention can be selected for a number of electrophotographic imaging processes, especially jumping development systems as illustrated in U.S. Pat. No. 4,299,900, the disclosure of which is totally incorporated herein by reference, especially those comprised of a fixed magnet, a nonmagnetic sleeve rotating around the fixed magnet, and a scraper blade comprised of a magnetic material. Since the single component magnetic and resinous material acquires a negative charge by rubbing on the rotating sleeve, the magnetic field between the blade and the magnet attracts the toner and holds it in that position. A blanket of toner is formed on the cylinder sleeve as it turns and is held there by the magnetic force. When a positive electrical charge is applied to the photoreceptor, and the biases applied to the sleeve and blade are sufficiently negative, the force of the magnet is overcome and the toner jumps to the photoreceptor creating an image in that area.

The toner compositions of the present invention can also include thereon known surface additives as indicted herein, such as AEROSILS TM, metal salts of fatty acids, such as zinc stearate, and the like, present in effective amounts of, for example, from about 0.1 to about 5 weight percent. These additives can be blended onto the toner surface by known means, and more specifically as illustrated herein.

The following examples are being submitted to further define various species of the present invention. These examples are intended to illustrate and not limit the scope of the present invention. Also, parts and percentages are by weight unless otherwise indicated. Comparative data and Examples are also provided. The crosslinked resin was prepared as illustrated in U.S. Pat. No. 4,824,750, the disclosure of which is totally incorporated herein by reference.

EXAMPLE I

There was prepared by melt mixing in a Banbury mill, followed by mechanical attrition, a toner composition comprised of 64 percent by weight of a crosslinked styrene n-butyl methacrylate resin with 58 percent by weight of styrene and 42 percent by weight of n-butyl methacrylate, 0.2 weight percent of divinylbezene, 1.4 weight percent of benzoyl peroxide, 30 percent by weight of untreated MAPICO BLACK TM obtained from Columbian Chemicals, 5 percent by weight of polypropylene wax available as Viscol 550P from Sanyo Chemical Company of Japan, and 1 percent by weight of the charge enhancing additive TRH, (3-hydroxy-4-(2-hydroxy-3,5-dinitrophenylazo)-n-phenyl-2-naphthalenecarboxamidato-2-hydrogen chromate) obtained from Hodogaya Chemical Company of Japan. After known classification in a Donald Classifier, there resulted toner particles with an average volume median diameter of about 12 microns as determined by an electrical sensing zone based on Ohm's Law (a Coulter Counter). Subsequently, there was added thereto with a Henschel blender Aerosil R812 TM, 0.4 weight percent, as a surface additive.

Thereafter, the formulated toner composition was incorporated into a Hewlett Packard SX printer test fixture with a jumping development, reference for example U.S. Pat. No. 4,299,900, the disclosure of which is totally incorporated herein by reference. There were obtained in the aforementioned imaging fixture developed images of acceptable quality, that is the image resolution and solid area density was excellent at 70° F., and 50 percent relative humidity (RH), however, there was offsetting of toner to the paper substrate, and a drop in solid area optical density as measured with an optical densitometer, from 1.41 to 1.04, when observed at 80° F. and 80 percent RH.

EXAMPLE II

A toner composition was prepared by melt blending at 5 minutes Banbury cycle and rubber mill cycle of 10 minutes followed by mechanical attrition. The toner comprised of 60 weight percent of styrene-n-butyl methacrylate, 58/42, 0.2 weight percent of divinylbenzene, 1.4 weight percent of benzoyl peroxide, 30 weight percent of untreated MAPICO BLACK TM magnetite, 9 percent of 550 P polypropylene wax obtained from Sanyo Corporation and believed to have an average molecular weight of 4,000, and 1 weight percent of the TRH charge additive of Example I. The toner product was then subjected to jet milling and classification. Thereafter, 0.4 percent by weight of Aerosil R812 TM was blended as a surface additive into the resulting toner at a Henschel blender speed of 752 RPM for 0.75 minute.

Subsequently, the formulated toner composition was incorporated into the SX printer of Example I. There were obtained in the aforementioned fixture images that displayed an excellent average solid area optical density of 1.43, and clear line characters at 70° F. and 65 percent RH, and no toner offsetting to the paper substrate. At 80° F. and 80 percent RH the densities were lower, a 1.22 average optical density, and this density varied signficantly from one developed copy to another developed copy, that is, for example, from copy to copy the standard deviation (SD) was as high as 0.8 and averaged 0.06 for about 500 developed copies.

EXAMPLE III

A toner was prepared by repeating the procedure of Example II with the exceptions that there was added 30 weight percent of the magnetite treated with (3-chloropropyl)trimethoxysilane, which magnetite was obtained from Toda Kogyo of Japan as MAT305K3. The Henschel blending speed for the external additive was 1,129 RPM. There were obtained in the test fixture of Example I images of average optical densities between 1.2 to 1.5 in a humidity range of 10 (60° F.) to 80 (80° F.) percent RH at temperatures of 60° to 80° F. for 500 developed images. Images of excellent resolution were obtained similar to those of Example I at the conditions indicated.

Developer compositions may be prepared by admixing the toners of the present invention with known carriers, such as those comprised of steel, ferrite, and the like cores, with a coating thereover. Examples of carriers are illustrated in U.S. Pat. Nos. 3,590,000; 4,937,166; 4,935,326 and the like, the disclosures of which are totally incorporated herein by reference.

Other modifications of the present invention may occur to those skilled in the art subsequent to a review of the present application. The aforementioned modifications, including equivalents thereof are intended to be included within the scope of the present invention.

What is claimed is:

1. A negatively charged toner composition consisting essentially of crosslinked resin particles, silane treated magnetite particles, wax particles, (3-hydroxy-4-(2hydroxy-3,5-dinitrophenylazo)-n-phenyl-2-naphthalenecarboxamidato-2-hydrogen chromate) as charge enhancing additive particles that impart or assist in imparting a negative charge to the toner composition, and surface additive particles; and wherein said silane is selected from the group consisting of (3-chloropropyl)-trimethoxysilane, hexamethyldisilazane, trimethylsilane, tristearyltitante, trimethylethyoxysilane, hexamethyldisiloxane and dimethylpolysiloxane; and wherein said toner is substantially resistant to moisture of from about 20 to about 80 percent relative humidity.

2. A toner composition in accordance with claim 1 wherein the resin is comprised of styrene acrylates, styrene methacrylates, or styrene butadienes.

3. A toner composition in accordance with claim 1 wherein the resin is comprised of styrene butyl methacrylate crosslinked with divinyl benzene.

4. A toner composition in accordance with claim 1 wherein the wax has a molecular weight of from about 500 to about 20,000.

5. A toner composition in accordance with claim 1 wherein the wax has a weight average molecular weight of from about 500 to about 5,000.

6. A toner composition in accordance with claim 1 wherein the wax is polypropylene or polyethylene.

7. A toner composition in accordance with claim 6 wherein the wax is present in an amount of from about 1 to about 12 percent by weight.

8. A toner composition in accordance with claim 1 wherein the magnetite is treated with a (3-chloropropyl)trimethoxysilane coating.

9. A toner composition in accordance with claim 1 wherein the charge enhancing additive is comprised of metal complexes of monoazo dyes.

10. A toner composition in accordance with claim 1 wherein the charge enhancing additive is [3-hydroxy-4-(2-hydroxy-3,5-dinitrophenylazo-N-phenyl-2-naphthalenecarboxamidato-2-hydrogen-chromate].

11. A toner composition in accordance with claim 1 wherein the surface additives are comprised of colloidal silicas.

12. A toner composition in accordance with claim 1 wherein the surface additives are comprised of metal salts of fatty acids.

13. A toner composition in accordance with claim 1 wherein the amount of toner resin is from about 50 to about 70 weight percent, the amount of silane magnetite is from about 20 to about 35 weight percent, the amount of wax is from about 1 to about 12 weight percent, the amount of charge additive is from about 0.1 to about 5 weight percent, and the amount of surface additive is from about 0.1 to about 1.2 weight percent.

14. A toner composition in accordance with claim 1 wherein the amount of toner resin is from about 58 to about 62 weight percent, the amount of silane magnetite is from about 28 to about 32 weight percent, the amount of wax is from about 8 to about 10 weight percent, the amount of charge additive is from about 0.85 about 1.5 weight percent, and the amount of colloidal silica surface additive is from about 0.3 to about 0.6 weight percent.

15. A toner composition in accordance with claim 1 which is substantially resistant to humidity.

16. A toner composition in accordance with claim 1 which is substantially resistant to moisture of from about 20 to about 80 percent relative humidity and from about 50° to about 80° F.

17. A toner composition in accordance with claim 1 with an average optical solid area density of from about 1.2 to about 1.5.

18. A method for obtaining images which comprises generating an electrostatic latent image on a photoconductive imaging member, subsequently affecting development of this image with the toner composition of claim 1, thereafter transferring the image to a permanent substrate, and optionally permanently affixing the iamge thereto.

19. A toner in accordance with claim 1 wherein the resin is a styrene n-butyl methacrylate crosslinked with a divinylbenzene, the silane is (3-chloropropyl)trimethoxysilane, the wax is polypropylene wax, the charge additive is (3-hydroxy-4-(2-hydroxy-3,5-dinitrophenylazo)-n-phenyl-2-naphthalenecarboxamidato-2-hydrogen chromate), and the surface additive is comprised of colloidal silica.

20. A toner in accordance with claim 1 with minimal offsetting and wherein said toner enables developed images with optical densities of 1.2 to 1.5.

21. A toner in accordance with claim 1 with stable optical densities at relative humidities of from about 50 to about 80 percent.

22. A toner in accordance with claim 1 wherein there is selected 64 percent by weight of a crosslinked styrene n-butyl methacrylate resin with 58 percent by weight of styrene and 42 percent by weight of n-butyl methacrylate, 0.2 weight percent of the crosslinking agent divinylbenzene, 1.4 weight percent of benzyl peroxide, 30 percent by weight of magnetite surface treated with 3-chloropropyl trimethoxy silane, which toner contained as a surface additive 0.4 weight percent of colloidal silica, and which toner has a humidity sensitivity in a range of from about 10 to about 80 percent relative humidity at a temperature of from about 60° F. to about 80° F.

23. A negatively charged toner composition consisting of a crosslinked resin, a silane treated magnetite, which silane is (3-chloropropyl) trimethoxy silane, wax, a charge enhancing additive that imparts or assists in imparting a negative charge to the toner composition, which additive is (3-hydroxy-4-(2-hydroxy-3,5-dinitrophenylazo)-N-phenyl-2-naphthalenecarboxamidato-2-hydrogen chromate), and a surface additive comprised of colloidal silicas; and wherein said toner is substantially resistant to moisture of from about 20 to about 80 percent relative humidity.

24. A toner in accordance with claim 23 wherein the magnetite is treated with a component selected from the group consisting of (3-chloropropyl)trimethoxysilane, hexamethyldisilazane, trimethylsilane, tristearyltitante, trimethylethyoxysilane, hexamethyldisiloxane and dimethylpolysiloxane.

25. A process for the preparation of substantially humidity insensitive negatively charged toner compositions consisting essentially of adding silane treated magnetite particles to crosslinked toner resin particles, wax particles, charge enhancing additives that impart a negative charge or assist in imparting a negative charge to the toner composition, and surface additive particles selected from the group consisting of colloidal silicas and metal salts of fatty acids; and wherein said silane is selected from the group consisting of (3-chloropropyl)-trimethoxysilane, the wax is polypropylene wax, the charge additive is (3-hydroxy-4-(2-hydroxy-3,5-dinitrophenylazo)-N-phenyl-2-naphthalenecarboxamidato-2-hydrogen chromate), and the surface additive is comprised of colloidal silica; and wherein said humidity is from about 20 to about 80 percent.

* * * * *